US007146759B2

(12) United States Patent
Bell

(10) Patent No.: US 7,146,759 B2
(45) Date of Patent: Dec. 12, 2006

(54) TWO-FACED OPTIONAL MAT PICTURE FRAMES

(76) Inventor: John Louis Bell, 2600 Timber Cove, Annapolis, MD (US) 21401

( * ) Notice: Subject to any disclaimer, the term of this patent is extended or adjusted under 35 U.S.C. 154(b) by 0 days.

(21) Appl. No.: 11/057,562

(22) Filed: Feb. 14, 2005

(65) Prior Publication Data

US 2006/0070286 A1 Apr. 6, 2006

Related U.S. Application Data

(60) Provisional application No. 60/615,557, filed on Oct. 1, 2004.

(51) Int. Cl.
*A47G 1/06* (2006.01)

(52) U.S. Cl. ..... 40/734

(58) Field of Classification Search ..... 40/702, 40/705–707, 710, 722–723, 733–735, 753, 40/761, 748–749, 773, 779, 781, 786, 789, 40/734, 606.18, 626, 737, 661, 661.06, 739, 40/740; 206/456

See application file for complete search history.

(56) References Cited

U.S. PATENT DOCUMENTS

| | | | | | |
|---|---|---|---|---|---|
| 359,316 | A * | 3/1887 | Damlos | 40/734 |
| 506,580 | A * | 10/1893 | Barthels | 40/618 |
| 560,080 | A * | 5/1896 | Booher | 40/734 |
| 596,835 | A * | 1/1898 | Van Hohenoff | 40/493 |
| 613,091 | A * | 10/1898 | Stengel | 40/749 |
| 896,753 | A * | 8/1908 | Peterson | 40/747 |
| 1,002,910 | A * | 9/1911 | Foote | 434/297 |
| 1,092,499 | A * | 4/1914 | Matsuo | 40/773 |
| 1,127,223 | A * | 2/1915 | Fogle | 40/611.04 |
| 1,649,415 | A * | 11/1927 | Moseson | 40/765 |
| 1,662,744 | A * | 3/1928 | Hardee | 206/776 |
| 1,777,435 | A * | 10/1930 | Hogelund | 52/203 |
| 1,816,776 | A * | 7/1931 | Haslun et al. | 40/611.07 |
| 1,822,492 | A * | 9/1931 | Lamb | 40/611.05 |
| 1,827,167 | A * | 10/1931 | Regan | 40/611.07 |
| 1,845,348 | A * | 2/1932 | Shepardson | 40/715 |
| 1,895,818 | A * | 1/1933 | Regan | 40/734 |
| 1,895,938 | A * | 1/1933 | Mutschler | 40/611.02 |
| 2,047,075 | A * | 7/1936 | Kremen | 248/465 |
| 2,050,136 | A * | 8/1936 | Tucker et al. | 40/734 |
| 2,086,443 | A * | 7/1937 | Rutyna | 40/733 |
| 2,134,833 | A * | 11/1938 | Morton | 40/606.18 |
| 2,411,368 | A * | 11/1946 | Dow | 206/103 |
| 2,416,976 | A * | 3/1947 | Barbieri | 40/734 |
| 2,533,778 | A * | 12/1950 | Eckhardt | 40/734 |
| 2,540,221 | A * | 2/1951 | Ten Hoeve et al. | 40/661 |
| 2,761,558 | A * | 9/1956 | McLean, Jr. | 206/456 |
| 2,796,689 | A * | 6/1957 | Yannone | 40/734 |
| 3,102,351 | A * | 9/1963 | Howell | 40/611.04 |
| 3,430,829 | A * | 3/1969 | Wilson et al. | 224/182 |
| 3,460,282 | A * | 8/1969 | Swirsky | 40/530 |
| 3,466,777 | A * | 9/1969 | Wistrand et al. | 40/605 |
| 3,599,361 | A * | 8/1971 | Bowman et al. | 40/711 |

(Continued)

*Primary Examiner*—Robert J. Sandy
*Assistant Examiner*—Jeffrey A. Sharp

(57) ABSTRACT

This invention discloses composite two faced picture, document and/or other artwork frames, each composed of two separate frames with panes permanently installed on elastomeric pads and fitted to allow pane to pane resilient contact with two sets of displayed material and mats clamped back to back between panes for alternate viewing of either side. Each pair of composite frames are opened and closed quickly and easily, by the user, for frequent changes of displayed material. A variety of methods of opening closing, hanging, or setting up for display, all designed for quick and easy operation, by the user without assistance or tools, are presented.

16 Claims, 4 Drawing Sheets

U.S. PATENT DOCUMENTS 3,624,873 A * 12/1971 Frey ..... 24/555
3,713,238 A * 1/1973 Hyman et al. ..... 40/773
3,826,026 A * 7/1974 Bevan ..... 40/644
3,908,955 A * 9/1975 Frechtman ..... 248/470
3,955,298 A * 5/1976 Kapstad ..... 40/782
3,956,837 A * 5/1976 Itano ..... 40/745
3,970,033 A * 7/1976 Lindner et al. ..... 116/63 P
3,990,670 A * 11/1976 Frechtman ..... 248/470
4,044,483 A * 8/1977 Williams ..... 40/737
4,045,291 A * 8/1977 Berger ..... 435/297.5
4,058,283 A * 11/1977 Frechtman ..... 248/469
4,077,515 A * 3/1978 Shoberg ..... 206/456
4,144,664 A * 3/1979 De Korte ..... 40/609
4,158,266 A * 6/1979 Gilmour ..... 40/765
RE30,734 E * 9/1981 Eckert ..... 40/497
4,337,590 A * 7/1982 Jackson ..... 40/615
4,393,612 A * 7/1983 Clark ..... 40/798
4,413,434 A * 11/1983 Rupert et al. ..... 40/661
4,423,563 A * 1/1984 Ondricek ..... 40/533
4,427,486 A * 1/1984 Green et al. ..... 156/517
4,429,015 A * 1/1984 Sheptak ..... 428/201
4,630,386 A * 12/1986 Wilson ..... 40/734
4,637,153 A * 1/1987 Kane et al. ..... 40/605
4,702,534 A * 10/1987 Witt et al. ..... 312/114
4,709,495 A * 12/1987 Buckwalter ..... 40/661
4,736,538 A * 4/1988 Pierce et al. ..... 40/779
4,790,093 A * 12/1988 Ernest et al. ..... 40/661
4,835,889 A * 6/1989 McClymonds ..... 40/606.09
4,975,590 A * 12/1990 Tanaka ..... 250/484.4
5,161,827 A * 11/1992 Grosso ..... 283/77
5,205,059 A * 4/1993 Doll ..... 40/718
5,230,172 A * 7/1993 Hsu ..... 40/732
5,253,439 A * 10/1993 Shanok et al. ..... 40/781
5,283,967 A * 2/1994 Abrams ..... 40/779
5,353,536 A * 10/1994 Erber et al. ..... 40/606.1
5,433,036 A * 7/1995 Ganal ..... 40/729
5,438,777 A * 8/1995 Howell ..... 40/790
5,522,163 A * 6/1996 Neugebauer ..... 40/780
5,529,173 A * 6/1996 Salacuse ..... 206/749
5,533,288 A * 7/1996 Lambert ..... 40/754
5,544,436 A * 8/1996 Lefkowitz ..... 40/124.2
5,544,438 A * 8/1996 Fazekas ..... 40/605
5,787,627 A * 8/1998 Snoke et al. ..... 40/791
5,832,646 A * 11/1998 Albin et al. ..... 40/762
5,887,373 A * 3/1999 Byers ..... 40/733
5,916,102 A * 6/1999 Peyton ..... 52/385
5,933,994 A * 8/1999 Misaresh ..... 40/649
5,950,342 A * 9/1999 Suesholtz ..... 40/768
5,960,573 A * 10/1999 Wong ..... 40/757
5,974,714 A * 11/1999 Jones ..... 40/768
6,112,445 A * 9/2000 Feeney ..... 40/747
6,148,556 A * 11/2000 Seki ..... 40/661
6,230,428 B1 * 5/2001 Albin ..... 40/730
6,237,782 B1 * 5/2001 Hunn ..... 211/47
6,349,494 B1 * 2/2002 Haggarty-Robbins ..... 40/723
6,367,181 B1 * 4/2002 Skoog ..... 40/591
6,502,365 B1 * 1/2003 Legrand et al. ..... 52/786.11
6,536,148 B1 * 3/2003 Heiliger ..... 40/721
6,553,704 B1 * 4/2003 Pigg ..... 40/734
6,574,896 B1 * 6/2003 Howell ..... 40/737
6,585,218 B1 * 7/2003 Friberg ..... 248/469
6,692,806 B1 * 2/2004 Woods ..... 428/40.1
6,775,939 B1 * 8/2004 Juern ..... 40/757
6,782,649 B1 * 8/2004 Adler ..... 40/734
6,851,556 B1 * 2/2005 Valdez et al. ..... 206/449
6,932,218 B1 * 8/2005 Kosann et al. ..... 206/449
6,968,641 B1 * 11/2005 Pollack ..... 40/733
2001/0039750 A1 * 11/2001 Venegas ..... 40/607
2002/0116854 A1 * 8/2002 Rappaport et al. ..... 40/776
2002/0139027 A1 * 10/2002 Kenney ..... 40/661
2003/0014892 A1 * 1/2003 Matsuda ..... 40/661
2003/0200690 A1 * 10/2003 Galloway ..... 40/779
2004/0111944 A1 * 6/2004 Gatt et al. ..... 40/781
2004/0154204 A1 * 8/2004 Fu ..... 40/661.01
2005/0102877 A1 * 5/2005 Stravitz ..... 40/734
2005/0155267 A1 * 7/2005 Hamilton ..... 40/734
2006/0016710 A1 * 1/2006 Kosann et al. ..... 206/455

* cited by examiner

TWO-FACED OPTIONAL MAT PICTURE FRAMES

CROSS REFERENCE TO RELATED APPLICATIONS

Copending nonprovisional applications: Not applicable

Provisional application No. 60/615,557 on this invention, filed Oct. 1, 2004.

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISC APPENDIX

Not applicable

BACKGROUND OF THE INVENTION

This invention relates to frames for pictures, documents, certificates etc. and more particularly to frames which display either side alternately as composites, composed of two frames and panes, fitted and secured together, which allow quick and easy changes of displayed materials in addition to an optional variety of mats to enhance each display as a suitably decorative item. Presently available picture and document frames usually provide for mounting a single picture which may be bordered by a custom (sometimes professionally) cut mat, all bound between a display glass pane on the front and a suitable non displayed protective cover on the back, all permanently secured within a single frame. Changing this combination to show different subject matter, or to change decorating schemes or mats require extensive dismantling and reassembling, sometimes requiring the services of a professional. There is an abundance of prior framing devices; some provide for displaying pictures from both sides. For example, U.S. Pat. No. 6,553,704 to Pigg discloses a two sided picture frame with slots for inserting pictures in separate transparent holders and a pivoted base for holding the frame at a proper viewing angle when sitting on a horizontal surface. U.S. Pat. No. 4,630,386 to Wilson discloses a frame with special corner connectors and longitudinal slots for insertion or removal of pictures. Other available frames provide two panes of glass, mounted in the usual permanent fashion, within a single frame for mounting pictures. This allows clear glass surrounding the picture to substitute for the usual mat and shows the wall or other back ground as the mat surrounding the picture.

BRIEF SUMMARY OF THE INVENTION

It is, therefore, an object of this invention to provide two-faced picture frames, constructed in the manner of, and of commonly used materials now used in ordinary picture frames, with the significant addition of resilient mounting of panes, and which can be quickly and easily opened, by the user, like the two sides of a book, (hinged together, or not) and lie flat while displayed materials (photographs, mats, montages, dried flowers, kid's kindergarten pictures, etc.) are carefully placed, face down for display on one side, and back-to-back, face up, for display on the other. The other fitted side can then be closed, securing the displayed materials in place.

It is another object to provide identical, or otherwise fitted frames to align perfectly back-to-back, and when connected, to serve as a single composite frame, or as a number of connected composite frames, which may be hung or set up for alternate viewing of either side, It is another object to provide individual frames with viewing glass panes, or panes of other transparent material, permanently installed in each frame by bonding on elastomeric pads extending continuously around all edges of each pane. This necessary change from traditional frame construction is to provide resilience on closing said frames together. Said resilient closing secures displayed materials in place and allows differences in expansion of frames and transparent panes.

Still other objects are to provide alternative means to secure said frames together back-to-back and to either hang them, or to set them up for display on desks, tables etc.

BRIEF DESCRIPTION OF THE SEVERAL VIEWS OF THE DRAWINGS

Other objects, features and advantages of the present invention will become more apparent from the following detailed description of the invention, and certain modifications thereof when taken together with the accompanying drawings in which.

DETAILED DESCRIPTION OF THE INVENTION

This invention, in all variations, consists of composite picture and document frames composed of two complete halves with glass, or other transparent panes permanently bonded on elastomeric pads in each half, fitted and aligned together to assure resilient contact between said panes, with said two halves hinged or otherwise connected to allow quick and easy opening and closing of said composite frame for alternate display of either side.

As prior art, e.g., U.S. Pat. Nos. 6,553,704 and 4,630,386, to Pigg and Wilson and other readily available picture frames indicate, it will be greatly advantageous to provide picture frames which are easily and quickly opened and closed by the user, and which allow two displays to be mounted back to back so that either side may be shown alternately and/or changed quickly, as desired.

Composite picture and document frames disclosed by this invention may be fabricated of any or all materials now found in picture frame and related industries; i.e. wood, in any combination of species and finish, bent, extruded or fabricated metals, any suitable molded or fabricated plastics and glass, etc. The only change in manufacture which might be encountered in making this invention may be development of suitable means for mounting and bonding panes on resilient border strips on each half of said composite frame. "Contact cement" or other suitable adhesives will bond foamed rubber strips such as is found in weather stripping, or foamed plastic strips such as that found in laminate flooring underlayment around all sides of each pane. Some difficulty and increased cost may arise due to packing and shipping frames with glass panes installed. Said frames, however, present no additional difficulty or expense to well-equipped "Frame" shops where picture frames are assembled and finished to some extent, by hand.

Figure 1:
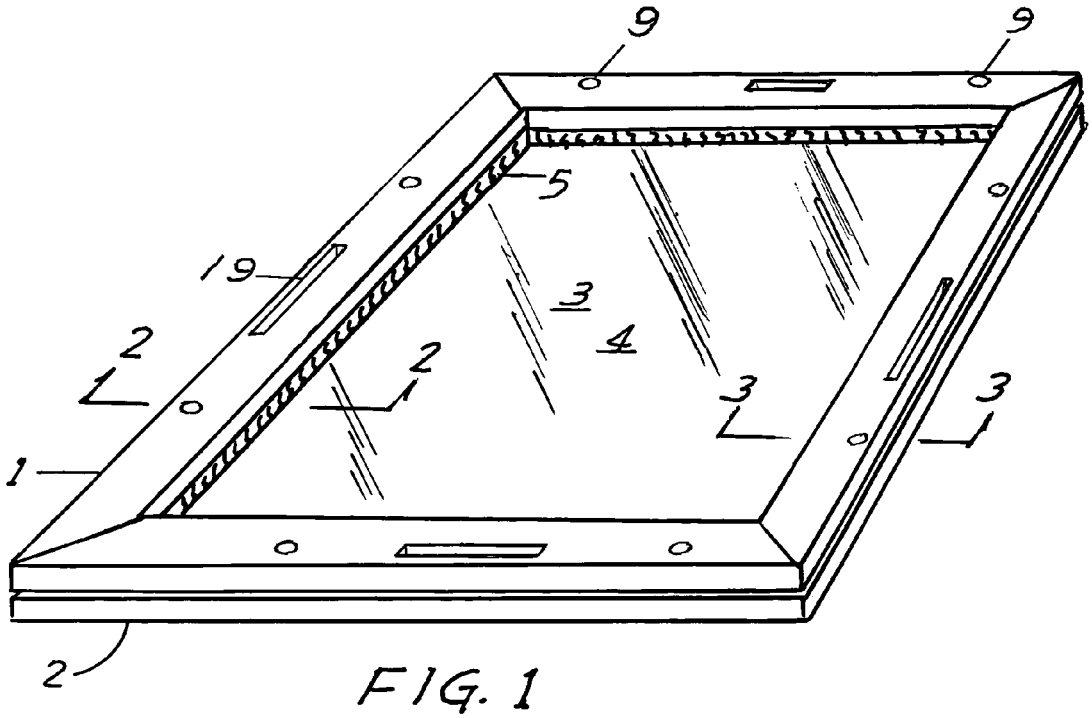
FIGS. 1, 2 & 3 are perspective and sectional views of a composite frame composed of two separate frames hinged together to allow each pane resilient contact pane to pane with the other when closed and latched, with each pane permanently secured in it's corresponding frame by bonding (contact cement or other suitable adhesive ) on elastomeric mounting strips between frames and panes.
Figure 18:
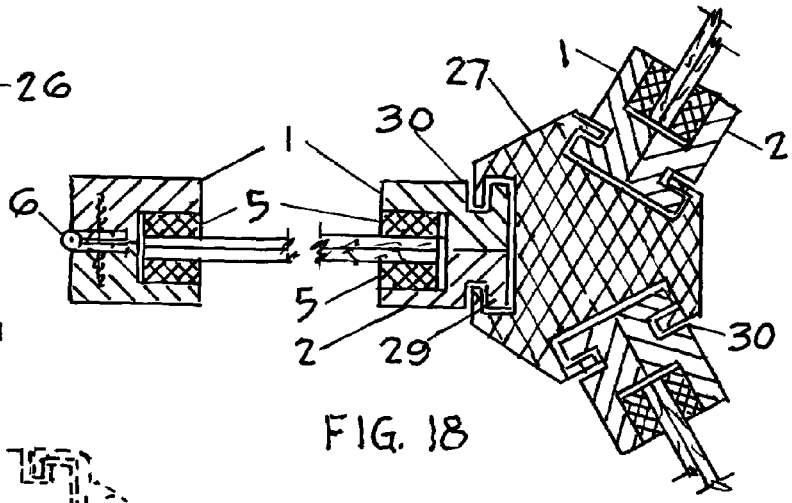
FIG. 18 is a plan sectional view of said center post connection detail indicated in FIG. 17.

In considering these drawings, please note that all sectional views, with the exception of FIG. 18, are sections of alternative frame members as cut in similar locations to those shown on drawing, sheet 1, FIG. 1, SECTIONS 2 & 3.

FIG. 1 is a perspective view of a composite frame composed of top half, 1 and lower half, 2, with panes, 3 & 4 mounted on resilient pads, 5, together with elongated through slots ,19,for wall hanging, and through holes, 9 for insertion of stand alone frame.

Figure 2:
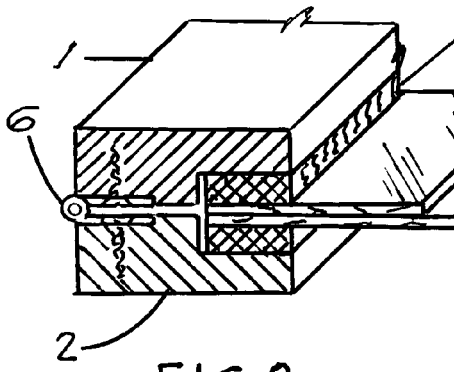

FIG. 2 is a sectional perspective view of a typical, hinge-connected composite frame member composed of top half 1, lower half 2, and panes 3 & 4, mounted on resilient pads 5, in which frame members 1 & 2, together, make up a single, two faced composite frame connected together in alignment by hinge 6. Said hinge allows sides of said composite frame to be opened like a book and lie flat, thus allowing changing and positioning of displayed material. Said displayed material is then clamped between panes 3 & 4 when said 'Book' is closed. Said hinge arrangement is preferred when clamping thickness of displayed material does not exceed allowable variation in dimension between panes 3 & 4. Said variation is made possible by limited resilience of elastomeric mounting cushions 5. Any number of hinges 6 may be used depending on the size of said composite frame. Full length 'piano' or hinges of other designs may be used.

Figure 3:
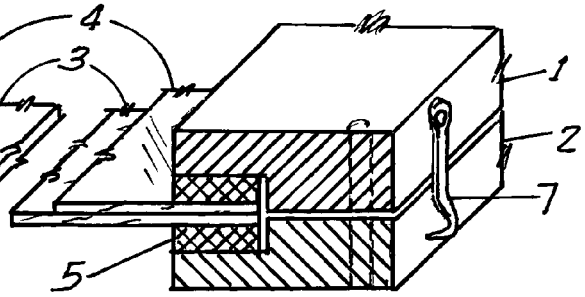

FIG. 3 is a sectional perspective view of said typical composite frame indicated in FIG. 2 showing a location of optional latch, 7, opposite hinge,6, for clamping two frame members 1 & 2 together. Other latches or connectors, i.e. as illustrated here in FIGS. 7,8,19, & 20 may substitute in combination with hinge closures.

Figure 4:
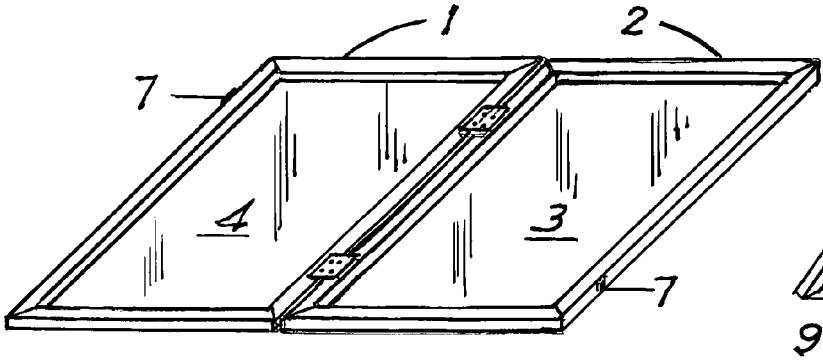
FIG. 4 is a perspective view of a pair of composite frames, lying flat in the open condition.

FIG. 4 is a perspective view of an open composite frame, showing panes 3 & 4, with sides, 1 & 2, connected by hinges 6 and locations of latches 7.

Figure 5:
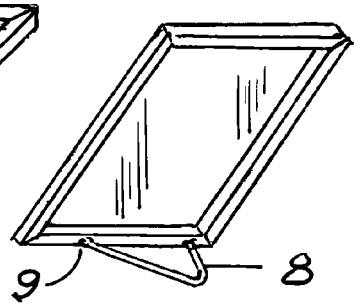
FIG. 5 is a perspective view of a composite frame supported and standing for viewing on a horizontal surface with bent wire support which may be inserted in holes in either side of said frame. This support is adaptable for use on any of these alternatives.

FIG. 5 is a perspective view of a composite frame supported, for standing alone, by removable bent wire support 8, inserted in support holes 9. Additional said support holes are located on a minimum of two adjacent sides of said composite frame to allow either "Landscape", horizontal or "Portrait", vertical displays.

Figure 6:
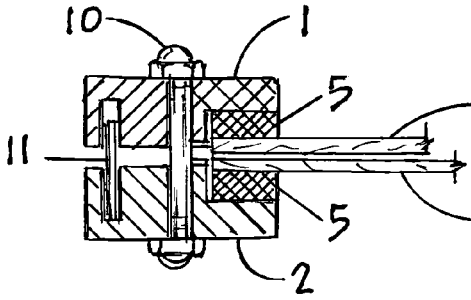
FIG. 6 is a sectional view of a typical frame member, showing an alternative bolting method for securing frames in proper alignment and thereby accommodating varying, larger display material thickness. Also shown is an optional continuous closure panel, used to change the relatively unfinished appearance resulting from said thicker display material.

FIG. 6 is a sectional view of two frame members 1 & 2, with elastomeric cushions 5, bonded to said frame members and to panes 3 & 4, secured together, at proper clamping dimension, by bolt, or double ended stud 110.This arrangement serves for more permanently, less frequently changed displays with suitably decorative bolts or studs with decorative nuts, suitable for hand operation. Said bolts or studs also properly align said frames. Optional continuous closure panels 11, mounted loosely in separate slots, provide aesthetic cover of open joints between frames 1 & 2 if desired.

Figure 7:
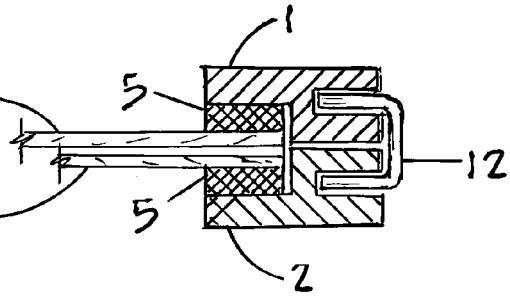
FIG. 7 is a sectional view of a frame member with "U" shaped connectors for securing composite frame members together. These connectors may substitute for latches in combination with hinges, as indicated in FIG. 3, and for clamping sides of composite frames not secured by other special connectors as indicated in FIGS. 17–20.

FIG. 7 is a sectional view of a typical composite frame member with sides 1 & 2,panes 3 & 4 and resilient mounting 5, clamped together by "U" shaped connector 12. Said connectors may be rod (round) material, or preferably small bars of rectangular cross section fitted in rectangular holes in said composite frames. Said rectangular bar clamping arrangement provides additional torsional resistance to misalignment of frames 1 & 2.

Figure 8:
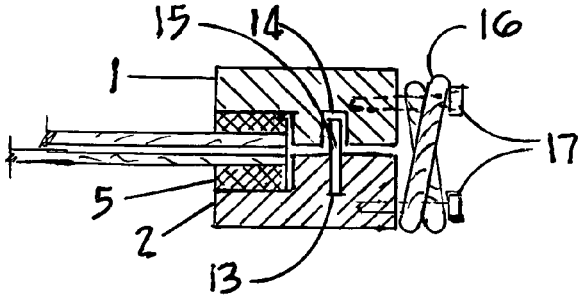
FIG. 8 is a sectional view of a cord binding arrangement with alignment and closure panel or optional alignment post details for maintaining said frames in proper alignment during and after cord binding.

FIG. 8 is a sectional view of a typical composite frame member, with halves 1 & 2 bound together by decorative and/or elastic cord 16, wound on suitably spaced binding posts 17. To maintain proper alignment of frame members 1 & 2 during and after binding , alignment posts 13, secured in one frame and sliding freely in the other, installed at diametrically opposite frame locations are required. More precise alignment and improved aesthetics may be obtained by modifying frames 1 & 2 with continuous slots 14, and adding continuous closing and alignment strips 15 secured in one frame and sliding freely in the other, in lieu of said alignment posts 13.

Figure 9:
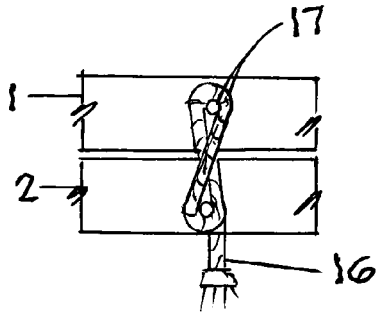
FIG. 9 is a side (also top and/or bottom) view of binding posts mounted on the outside of frame members with cord binding wrapped on said posts for securing frames together at variable clamping dimensions between panes as required.

FIG. 9 is an outside view of a cord binding arrangement for clamping frames together. Binding posts 17 are located suitably on outside surfaces of frame members 1 & 2. Decorative and/or elastic binding cords 16 bind and secure said frames at proper clamping dimension to accommodate variable thickness of displayed material.

Figure 10:
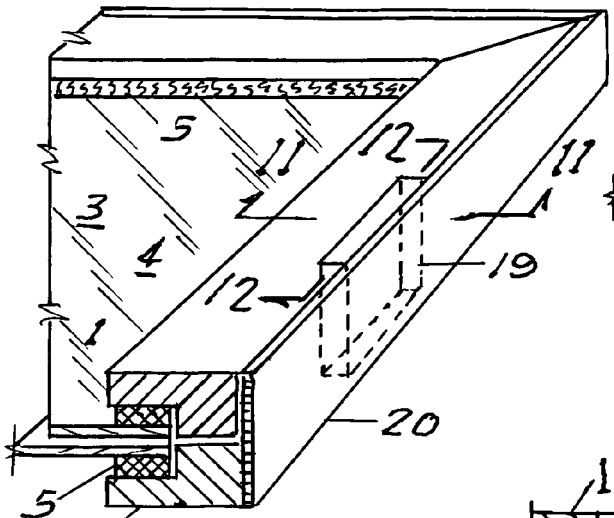
FIG. 10 is a plan sectional view of a portion of a composite frame with wall hanging slots formed, in part, by additional continuous outside frame members which also close the gap created by typical identical frame members

FIG. 10 is a plan sectional view of a portion of a composite frame consisting of two sides, 1 & 2, identical in all respects except that an additional border 20, a member equal in width to the combined thickness of said two identical sides with resilient pads 5 and panes 3 & 4 in place. Said additional member extends around all sides of said composite frame and is bonded, or otherwise permanently connected to bottom member 2 of said frame. This maintains alignment of said frames while permitting top frame 1 to slide freely out of the confines of said member 20, this allows changing of displayed material when restraining clamps are removed. This arrangement closes the gap which exists between said frame sides 1 & 2, and forms the outside of wall hanging slot 19.

Figure 11:
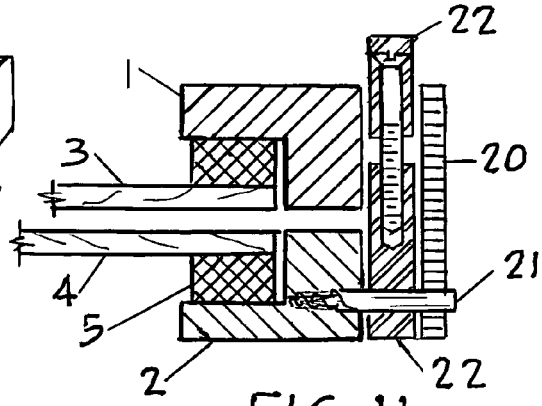
FIG. 11 is a sectional view of said (FIG. 10) frame member at the location of a wall hanging slot in the end of which a latch for securing two halves of a composite frame is installed.

FIG. 11 is a sectional view of a portion of a composite frame composed of typical members 1 & 2, with mounting pads 5 and panes 3 & 4 at a location of wall hanging slot 19 showing latch members 22 connected by hinge pin 21 to members 2 & 20.

Figure 12:
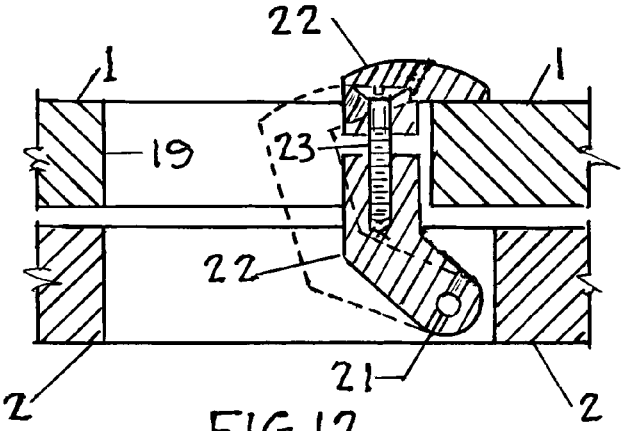
FIG. 12 is an additional sectional view of said frame member indicating location and operation of said latch. A sufficient number (minimum of two) of said latches, located at approximately diametrically opposite locations, are required for each composite frame.

FIG. 12 is a sectional view of said portion of a composite frame with adjustable latch 22 in place connecting members 1 & 2. Latch 22 consists of top and bottom portions connected by adjusting screw 23. Latch 22 pivots on, and is connected to frame members 2 & 20 by hinge pin 21. Frame member 1 is disconnected by rotating latch 22, as indicated. Said top and bottom portions of latch 22 are connected by adjusting screw 23 which allows adjustments for varying thickness of displayed materials. By locating latches within wall hanging slots 19, this arrangement effectively hides and protects relatively fragile latches which are operated by thumb pressure on the small curved portion extending above the level of member 1.

Figure 13:
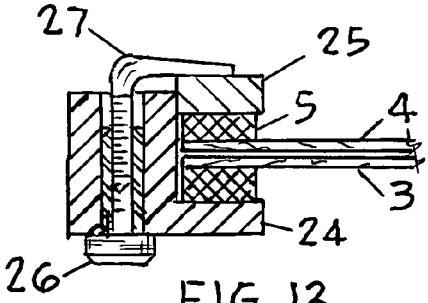
FIG. 13 is a sectional view of a pair of not-identical frame members at locations of fully adjustable, and easily disengaged clamps for securing frames together. A sufficient number of these clamps, placed around the periphery of said frames, secure displayed materials together at proper variable displayed material thickness between frames. This clamping arrangement accommodates any reasonable combined thickness of displayed materials together with single or multiple mats.

FIG. 13 is a sectional view of a composite frame member consisting of two not-identical frames 24 & 25, with means for clamping said two sides together. This clamping arrangement, utilizing elements 26 & 27, provides fully adjustable clamping dimensions between panes 3 & 4. Frame member 24 is "L" shaped in cross section with elastomeric cushion pad 5, bonded to both frame member 24, and to pane 3. Frame member 25, is a simple rectangular cross section. The half-frame, formed on all sides by member 25, as an inside frame, is sized to fit within said frame formed on all sides by member 24, thereby insuring alignment between two sides of said composite frame. This embodiment facilitates displaying materials of varying thickness between said panes by adjusting threaded connections between clamp elements, 26 & 27. Clamp element 26 is a hollow, internally threaded tube, inserted rotatably in holes through frame member 24,with a bolt head of a type suitable for hand operation, bearing against the surface of said member, 24. Clamp element 27 is a cylindrical member with external threads mated to said internal threads of member 26 and an unthreaded end, formed at ninety degrees to said threaded end, fitted to bear against frame member 25. By loosening said clamp and turning said formed end at least ninety degrees, said frame formed by member 25 is easily removed and set aside while display materials are changed.

Figure 14:
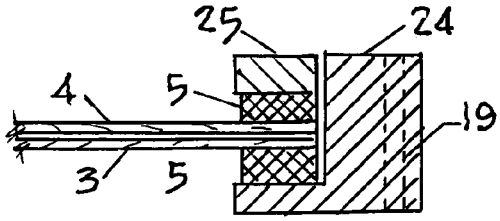
FIG. 14 is a sectional view of said pair of not-identical frame members showing details of inside and outside frames for said clamping arrangement and bonding of elastomeric cushion mounting of viewing panes.

FIG. 14 is a sectional view of said composite frame member of FIG. 13, composed of not-identical frame members 24 & 25, in a closed, composite condition, as in FIG. 13, between locations of said screw operated clamps.

Figure 15:
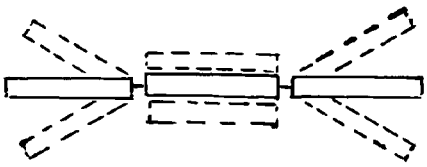
FIG. 15 is a plan view of a number of composite frames hinged together for displays of two sides of each. With use of special hinges (shown in FIGS. 20 & 21) an infinite variety of angular arrangements for standing alone, straight alignments for wall hanging, and fully folded arrangements are illustrated.
Figure 19:
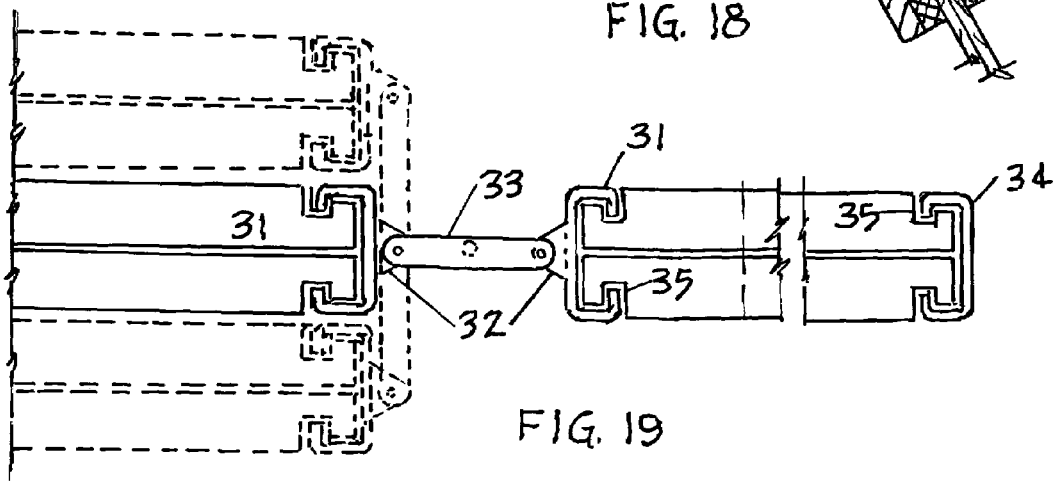
FIGS. 19 & 20 are plan and elevation views of a special hinge and clamping details for connecting a number of composite frames to achieve varieties of angular stand-alone and/or wall hanging configurations.
Figure 20:
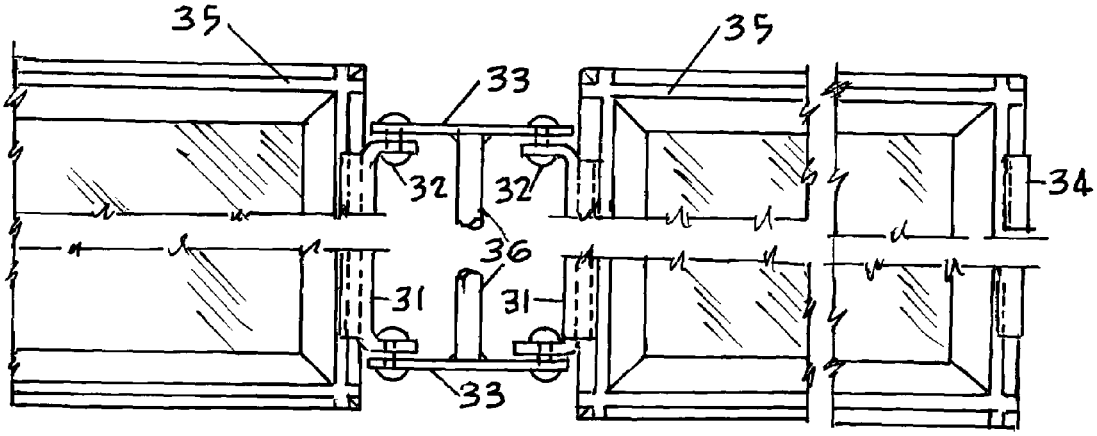

FIG. 15 is a plan view of a number of composite frames connected with double offset hinges end to end, as detailed in FIGS. 19 & 20, angled together for free standing on a horizontal surface, hinged in straight line for wall hanging, or folded for shipping or storage.

Figure 16:
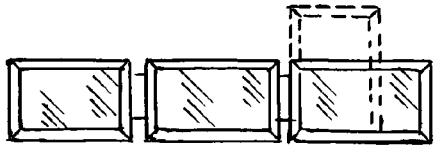
FIG. 16 is an elevation view of composite frames, hinged together for free standing, in addition to possible horizontal and/or vertical combinations of frames.

FIG. 16 is an elevation view of a number of composite frames, hinged together as detailed in FIGS. 19 & 20, illustrating the possibility of clamping frames in combinations of either horizontal ("Landscape") or vertical ("Portrait") orientations.

Figure 17:
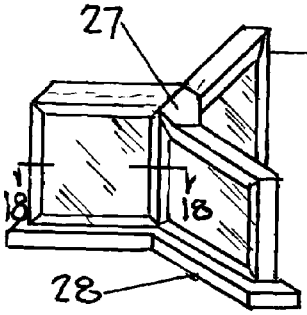
FIG. 17 is a perspective view of a fixed center post connection detail: an arrangement for connecting 2, 3, Or 4 individual composite frames as stand-alone "portrait" and/or "landscape" orientation of displays in which said center post serves as means of clamping said composite frames together opposite hinged or otherwise connected sides.

FIG. 17 is a perspective view of a fixed stand-alone arrangement for connecting two, three, or four individual composite frames 26, in any "Landscape", or "Portrait" combination by connecting said frames to center post 27, which is fixed to base 28.

FIG. 18 is a sectional view of a connecting center post 27, in which "T" slots 29, mesh by sliding vertically in slots 30 in composite frame members 1 & 2, thereby clamping said members together. Hinge 6, opposite said center post, provides clamping for extended ends of composite frames, and ease of maintaining alignment and opening and closing said composite frames. Other combinations of composite frame alignment posts, closing strips and/or clamping devices, as disclosed in FIGS. 2, 7, 8,19 & 20, may be chosen as alternates for said hinge.

FIG. 19 is a plan view of a double offset hinge for connecting a number of composite frames in any angular, configuration for free standing or wall hanging, as well as completely folded for storage and shipping. Said hinges are composed of "C" shaped clamp element 31, which is fitted to slide in slots 35, on outsides of frame members, thereby clamping said composite frames together. Pivot point extensions 32, at the top and bottom of each "C" clamp, connect offset hinge members 33 to an identical "C" shaped clamp 3 1which connects, as above, to an adjacent composite frame. Sides of composite frames not clamped by hinge members, as above, may be clamped by "C" clamps 34, similar in all respects to hinge member 33, without pivot points. As noted in FIG. 18, hinges 6, or other methods of assuring alignment and clamping of individual frame members may be used.

FIG. 20 is an elevation view of said double offset hinge for connecting composite frames in any angular configuration. Hinge element 31 slides vertically in slots 35 to clamp composite frame members together in either "landscape" and/or "portrait" displays as illustrated in FIG. 16. Offset hinge members 33, connect said two identical sides 31 at pivot points 32. Said hinge assembly is stabilized by torsion member 36, which is permanently joined to offset members 33. As noted in FIGS. 18 & 19, other methods of assuring alignment and clamping of frame members may be substituted for sliding clamp 34, as shown.

Having now fully set forth the embodiments and certain modifications of the concepts underlying the present invention, various other embodiments as well as certain variations and modifications of the embodiments herein shown and described will obviously occur to those skilled in the art upon becoming familiar with said underlying concepts. It is to be understood, therefore, that this invention may be practiced otherwise than as specifically set forth in the appended claims.

What I claim as my invention is:

1. A composite two-faced picture frame for displaying documents and artwork; said composite two-faced picture frame being adapted for quick assembly and disassembly by hand, and further being configured to display separate images when viewed from either side of the frame, said composite two-faced picture frame comprising:

a first frame comprising a first frame body comprised of a plurality of frame segments, each segment having a generally L-shaped cross-section, which defines a first recess in the first frame body, a first transparent pane corresponding in shape with, and being disposed within said first recess, and a first elastomeric pad disposed within said first recess and being permanently bonded between the first frame body and one face of the first transparent pane, said first elastomeric pad extending continuously around the perimeter of said first transparent pane and forming a cushion so as to allow the first transparent pane to move resiliently with respect to said first frame body;

a second frame comprising a second frame body comprised of a plurality of frame segments, each segment having a generally L-shaped cross-section, which defines a second recess in the second frame body, a second transparent pane corresponding in shape with, and being disposed within said second recess, and a second elastomeric pad disposed within said second recess and being permanently bonded between the second frame body and one face of the second transparent pane, said second elastomeric pad extending continuously around the perimeter of said second transparent pane and forming a cushion so as to allow the second transparent pane to move resiliently with respect to said second frame body;

a means for securing and aligning each of said first and second frames together; and, a means for supporting said composite two-faced picture frame;

wherein, said first and second frames are positioned back to back in such a way that said first and second transparent panes are capable of contacting each other and maintaining a document or piece of artwork having various thicknesses therebetween.

2. A composite two-faced picture frame as defined in claim 1, wherein said means for securing and aligning each of said first and second frames together comprises a plurality of latches disposed in a predetermined pattern suitable for securing and retaining said composite two-faced picture frame in a closed position.

3. A composite two-faced picture frame as defined in claim 1, wherein said means for supporting the composite two-faced picture frame comprises an elongated slot centered on at least one segment of the first or second frame body, wherein said elongated slot is sized to engage wall hangers, provide small horizontal adjustments of the composite two-faced picture frame, and insure level hanging.

4. A composite two-faced picture frame as defined in claim 1, wherein said means for supporting the composite two-faced picture frame comprises a removable bent wire support for free-standing the composite two-faced picture frame on horizontal surfaces, and corresponding holes located on at least one segment of the first or second frame body which are sized to receive two ends of said removable bent wire support.

5. A composite two-faced picture frame as defined in claim 1, wherein said means for supporting the composite two-faced picture frame comprises an elongated slot centered on at least one segment of the first or second frame body, and wherein said means for securing and aligning each of said first and second frames together comprises a latch partially hidden by and installed within said elongated slot.

6. A composite two-faced picture frame as defined in claim 1, wherein said means for securing and aligning each of said first and second frames together comprises a cord binding arrangement for clamping the first frame to the second frame, wherein the cords may be decorative and/or elastic.

7. A composite two-faced picture frame as defined in claim 1, wherein said means for securing and aligning each of said first and second frames together comprises:

a first interior slot spanning a length of one segment of the first frame body, a second interior slot spanning a length of one segment of the second frame body, said first and second slots being continuous and adjacent to one another, and a hidden alignment strip situated within each of said first and second interior slots to secure and retain the composite two-faced picture frame in a closed position.

8. A composite two-faced picture frame as defined in claim 1, wherein said means for securing and aligning each of said first and second frames together comprises at least one pair of alignment posts, each alignment post having a first free end sliding into the first frame body and a second free end sliding into the second frame body.

9. A composite two-faced picture frame as defined in claim 1, wherein said means for securing and aligning each of said first and second frames together comprises at least two studs or bolts which may comprise decorative heads and nuts.

10. A composite two-faced picture frame as defined in claim 1, wherein said means for supporting the composite two-faced picture frame comprises a removable bent wire support for free-standing the composite two-faced picture frame on horizontal surfaces, and corresponding holes located on at least one segment of the first or second frame body which are sized to receive two ends of said removable bent wire support.

11. A composite two-faced picture frame as defined in claim 1, wherein said means for securing and aligning each of said first and second frames together comprises at least one clamp, wherein said clamp allows assembly and disassembly of the first and second frames without the use of tools.

12. A composite two-faced picture frame as defined in claim 1, wherein said means for securing and aligning each of said first and second frames together comprises exterior slots in each segment of each of the first and second frame bodies, said exterior slots being configured to engage C-shaped clamp connectors having double offset hinges which allow full 360 degree rotation, wherein any number of composite two-faced picture frames can be connected to each other end to end, in a variety of arrangements.

13. A composite two-faced picture frame as defined in claim 12, further comprising a double offset hinge having two identical C-shaped clamp connectors sized to match said exterior slots such that the C-shaped clamp connectors can slide into said exterior slots to clamp the first and second frames together, and two double-pivot torsionally stabilized offset hinge members sized to allow multiple composite two-faced picture frames to fold side by side.

14. A composite two-faced picture frame as defined in claim 1, wherein said means for securing and aligning each of said first and second frames together comprises one or more hinges which allow the composite two-faced picture frame to open and close like a book.

15. A composite two-faced picture frame as defined in claim 14, wherein said means for securing and aligning each of said first and second frames together further comprises one or more latches located diametrically opposite to said one or more hinges, said one or more latches serving to secure and retain said composite two-faced picture frame in a closed position.

16. A composite two-faced picture frame as defined in claim 14, wherein said means for securing and aligning each of said first and second frames together further comprises a first exterior slot spanning a length of one segment of the first frame body, and being diametrically opposite said one or more hinges, a second exterior slot spanning a length of one segment of the second frame body, spanning a length of one segment of the first frame body, and being diametrically opposite said one or more hinges, wherein said first and second exterior slots enable said composite two-faced picture frame to engage T-shaped interior slots in a fixed angle connection post, wherein the interior T-shaped slots serve to secure and retain the composite two-faced picture frame in a closed position and further serve as said means for supporting the composite two-faced picture frame.

* * * * *